US005286394A

United States Patent [19]

Moore

[11] Patent Number: 5,286,394

[45] Date of Patent: Feb. 15, 1994

[54] FUEL ECONOMY AND OXIDATION INHIBITION IN LUBRICANT COMPOSITIONS FOR INTERNAL COMBUSTION ENGINES

[75] Inventor: Lionel D. Moore, Lisle, Ill.

[73] Assignee: Ethyl Corporation, Richmond, Va.

[21] Appl. No.: 73,453

[22] Filed: Jun. 7, 1993

Related U.S. Application Data

[63] Continuation of Ser. No. 877,853, May 4, 1992, abandoned, which is a continuation of Ser. No. 534,958, Jun. 8, 1990, abandoned, which is a continuation-in-part of Ser. No. 371,911, Jun. 27, 1989, abandoned.

[51] Int. Cl.[5] ..... C10M 129/40; C10M 129/70

[52] U.S. Cl. ..... 252/36; 252/35; 252/51.5 R; 252/56 R

[58] Field of Search ..... 252/51.5 R, 35, 36

[56] References Cited

U.S. PATENT DOCUMENTS

| | | | |
|---|---|---|---|
| 4,231,883 | 11/1980 | Malec | 252/51.5 R |
| 4,459,223 | 7/1984 | Shaub et al. | 252/51.5 R |
| 4,664,822 | 5/1987 | Hunt et al. | 252/32.7 E |
| 4,704,217 | 11/1987 | Sweeney et al. | 252/51.5 R |
| 4,767,551 | 8/1988 | Hunt et al. | 252/32.7 E |

*Primary Examiner*—Ellen M. McAvoy

[57] ABSTRACT

A friction-reducing lubricating oil composition and a method for reducing the fuel consumption of an internal combustion engine are disclosed. The lubricating oil composition comprises (a) a major amount of an oil having lubrication viscosity; (b) a minor amount of a friction-modifying, polar and surface-active compound; (c) a minor amount of a Group IA alkoli metal containing compound and (d) a minor amount of a transition element metal in a hydrocarbon-soluble or dispersible compound. The method for reducing fuel consumption of a spark-ignited internal combustion engine comprises utilizing an embodiment of the lubricating oil composition in the crankcase of the engine.

17 Claims, No Drawings

FUEL ECONOMY AND OXIDATION INHIBITION IN LUBRICANT COMPOSITIONS FOR INTERNAL COMBUSTION ENGINES

This is a continuation of copending application Ser. No. 07/877,853 filed on May 4, 1992, now abandoned which is a continuation of application Ser. No. 07/534,958, filed Jun. 8, 1990, now abandoned which is a continuation-in-part of Ser. No. 07/371,911, filed Jun. 27, 1989, now abandoned.

BACKGROUND OF THE INVENTION

1. Field of the Invention

This invention relates to friction-reducing lubricating oil compositions which provide improved fuel economy and oxidation inhibition in internal combustion engines. More particularly, this invention relates to finished lubricating oil compositions that contain both a fuel economy additive system and an antioxidant component. The fuel economy system comprises: (1) a member selected from the group consisting of mono and higher esters of polyols, primary amines, primary ether amines, ether diamines, polyethoxylated amines and polyethoxylated diamines, ethoxylated ether amines, the said amines and diamines containing alkyl and alkylene groups of from 2 to about 30 carbon atoms, aliphatic amides and polyethoxylated amides containing alkyl and alkylene groups of up to about 30 carbon atoms; and (2) a compound containing a Group IA metal of the Periodic Table wherein the Group IA metal is present in the finished lubricating oil in an amount of from about 10 ppm (wt) to less than about 1000 ppm (wt). The antioxidant component comprises a transition element metal compound that is soluble or at least dispersible in hydrocarbons, wherein the metal is a transition metal of an atomic number of from 21 to 47 of the Periodic Table of Elements.

2. Description of the Prior Art

Since the automobile fuel shortage of the 1970's, emphasis has been placed on the conversion of energy and fuels. The government of the United States of America has enacted Federal Regulations which define gasoline-mileage requirements which must be met by the automobile manufactures in that the new automobiles must provide a specified minimum gasoline mileage. The newer automobiles are smaller in size and lighter in weight, as a result of these regulations.

Another way to conserve fuel is to use friction-reducing additive materials in the lubricating oils employed in crankcases of internal combustion engines. A reduction in friction in the engine results in a decrease in the amount of fuel consumed by that engine.

It is known that various lubricating oil additives are capable of reducing the amount of fuel that is consumed by an internal combustion engine. For example, in United Kingdom Patent Application GB 2,097,813A, it was disclosed that certain esters provide reduced fuel consumption. In U.S. Pat. No. 4,208,293, Zaweski disclosed that a fatty acid amide of diethanolamine, or a fatty acid ester of diethanolamine, or a mixture thereof, or esteramides formed therefrom can be used as additives in a lubricating oil composition to reduce friction in an internal combustion engine. In U.S. Pat. No. 4,201,684, Malec taught that a sulfurized fatty acid ester, a sulfurized fatty acid amide, or a sulfurized fatty acid esteramide of an alkoxylated amine, such as ethanolamine, can be used also as a friction modifier in a lubricating oil composition. In U.S. Pat. No. 4,383,931, Ryu et al. disclosed that an oil-soluble molybdenyl bis-b-diketonate is capable of providing antifriction properties to a lubricating oil composition when used in combination with an oil-soluble active sulfur donor, such as zinc dialkyldithiophosphate, In U.S. Pat. No. 4,326,972 and its British equivalent, United Kingdom Patent Application GB 2,023,169A, Chamberlin III disclosed certain lubricating oil compositions and a method for reducing fuel consumption in an internal combustion engine. He stated that fuel economy is attained by employing a lubrication oil composition comprising: (1) an oil of lubrication viscosity; (2) a sulfurized mixture comprising at least one ester of a substantially aliphatic carboxylic acid containing from about 8 to about 30 carbon atoms and a substantially aliphatic alcohol, at least one substantially aliphatic carboxylic acid containing from about 8 to about 30 carbon atoms, and at least one substantially aliphatic monoolefin containing from about 8 to about 36 carbon atoms; and (3) at least one oil-dispersible basic alkali metal sulfonate. He disclosed that such a lubricating oil composition, when used as a crankcase oil in an internal combustion engine, improves the operation of that engine by decreasing fuel consumption.

European Patent Application No. 83302155.3 (European Publication No. 092946) taught that a partial ester of a fatty carboxylic acid containing from 16 to 18 carbon atoms and glycerol and an oil-soluble organic copper compound, when present in a lubricating oil composition, act together to reduce friction in the crankcase of an internal combustion engine utilizing said composition.

In U.S. Pat. No. 4,280,916, Richards et al., disclose a motor oil composition which contains an oil of lubricating viscosity, an ashless dispersant, such as a polyisobutenyl succinate, an oil-soluble detergent sulfonate, salicylate, and/or phenate, and at least one $C_8$–$C_{24}$ aliphatic monocarboxylic acid amide, the latter being present in an amount that is sufficient to reduce fuel consumption of an internal combustion engine that is employing the motor oil composition as the crankcase lubricating oil of that engine.

Now there has been found unexpectedly a lubricating oil composition that not only reduces fuel consumption, but also provides outstanding stability to oxidative degradation.

SUMMARY OF THE INVENTION

According to the present invention, there is provided a friction-reducing lubricating oil composition and a method for reducing the fuel consumption of an internal combustion engine. The finished lubricating oil composition comprises: (a) a major amount of an oil having lubrication viscosity; (b) a minor amount of a friction-modifying, polar, and surface-active organic compound selected from the group consisting of mono and higher esters of polyols, primary amines, primary ether amines, ether diamines, polyethoxylated amines, polyethoxylated diamines, ethoxylated ether amines, aliphatic amides and polyethoxylated amides; (c) a minor amount of a Group IA alkali metal-containing compound wherein the Group IA metal, preferably sodium, is present in the finished lubricating oil in an amount of from about 10 ppm (wt) to less than about 1000 ppm (wt); and (d) a minor amount of an antioxidant comprising a hydrocarbon-soluble or dispersible transition element metal compound, wherein the transition metal is of an atomic number from 21 to 47 of the Periodic Table of Elements. The preferred transition metal is copper. There is also provided a method for improving fuel economy in a spark-ignited internal combustion engine, which method comprises utilizing in the crankcase of said engine an embodiment of the lubrication oil composition of the present invention.

DESCRIPTION OF THE INVENTION AND PREFERRED EMBODIMENTS

As pointed out hereinabove, an important feature when operating an internal combustion engine is to operate that engine on an economical basis. This includes the consumption of fuel. The more that friction can be reduced when an internal combustion engine is performing, the less costly becomes the operation of that engine. A good way of reducing the friction in an internal combustion engine is the employment of a friction-reducing additive in the lubricating oil composition that is used in the crankcase of that particular engine. The less friction that is involved, the more efficient is the operation of the engine. Consequently, lubrication oil compositions that contain additives providing friction-reduction properties are desired.

It has been found unexpectedly that a finished lubrication oil composition comprising: (a) a major amount of an oil having lubrication viscosity; (b) a minor amount of a friction-modifying, polar, and surface-active organic compound selected from the group consisting of mono and higher esters of polyols, primary amines, primary ether amines, ether diamines, polyethoxylated amines, polyethoxylated diamines, ethoxylated ether amines, aliphatic amides and polyethoxylated amides containing alkyl and alkenyl groups of up to 30 carbon atoms; (c) a minor amount of a Group IA alkali metal-containing compound wherein the Group IA alkali metal is present in the finished lubricating oil in an amount of from about 10 ppm (wt) to about less than 1000 ppm (wt); and (d) a minor amount of an antioxidant comprising a transition-metal compound that is soluble or at least dispersible in hydrocarbons provides good friction reduction characteristics.

Accordingly, there is provided a finished lubricating oil composition for improving fuel economy in a spark-ignited internal combustion engine, which composition comprises: (a) a major amount of an oil having lubricating viscosity; (b) a minor amount of a friction-modifying, polar, and surface-active organic compound selected from the group consisting of mono and higher esters of polyols, primary amines, primary ether amines, ether diamines, polyethoxylated amines, polyethoxylated diamines, aliphatic amides and polyethoxylated amides, ethoxylated ether amines, said amines and amides containing alkyl and alkenyl groups of up to 30 carbon atoms; (c) a minor amount of a Group IA alkali metal-containing compound; and (d) a minor amount of an antioxidant comprising a transition element metal compound that is soluble or at least dispersible in hydrocarbons.

In addition, there is provided a method for improving fuel economy in a spark-ignited internal combustion engine, which method comprises utilizing in the crankcase of said engine a finished lubrication oil composition comprising: (a) a major amount of an oil having lubricating viscosity; (b) a minor amount of a friction-modifying, polar, and surface-active organic compound selected from the group consisting of said mono and higher esters of polyols, and said amines and amides; (c) a minor amount of a Group IA alkali metal-containing compound; and (d) a minor amount of an antioxidant comprising a transition-element metal compound that is soluble or at least dispersible in hydrocarbons and that provides good friction reduction characteristics.

The finished lubricating oil composition of the present invention comprises a major amount of a hydrocarbon oil having lubrication viscosity. Such hydrocarbon oil can be a natural oil, a synthetic oil, or a mixture of natural oils and/or synthetic oils.

Among the natural oils are animal oils, vegetable oils, and liquid petroleum oils. Liquid petroleum oils of viscosity, such as 5W, 10W, 40W, or of greater viscosity, which include naphthenic base, paraffinic base, and mixed-based mineral oils, are suitable. In addition, hydrocarbon oils of lubrication viscosity that are derived from coal and shale are suitable natural oils.

Synthetic oils that are suitable lubricating oils include polymerized and interpolymerized olefins, such as polybutylenes, polypropylenes, and propylene-isobutylene copolymers; alkylbenzenes, e.g., dodecylbenzenes and dinonylbenzenes; polyphenyls, such as biphenyls and alkylated polyphenyls; alkylated diphenyl ethers and alkylated diphenylsulfides and derivatives, analogs, and homologs thereof. Moreover, alkylene oxide polymers and interpolymers and derivatives thereof where the terminal hydroxyl groups have been modified by esterification or esterification, e.g., oils prepared through polymerization of ethylene oxide or propylene oxide, the alkyl and aryl ethers of these polyoxyalkylene polymers, or mono- and polycarboxylic esters thereof, such as acetic acid esters or mixed $C_3$–$C_8$ fatty acid esters, are suitable synthetic lubricating oils. Additional suitable synthetic oils that can be used as lubricating oils are esters of dicarboxylic acids, such as phthalic acid, succinic acid, maleic acid, alkyl succinic acids or alkenyl succinic acids, and esters made from $C_5$ to $C_{12}$ monocarboxylic acids and polyols and polyol ethers, e.g., neopentyl glycol and tripentaerythritol.

In general, any oil of lubricating viscosity can be used as the major component of the lubrication oil composition of the present invention. For example, oils having viscosities in the range of about 15 Saybolt Universal Seconds (SUS) at 100° C. (212° F.) to about 250 SUS at 100° C. (212° F.) are suitable. Oils which have viscosities in the range of about 15 SUS at 100° C. (212° F.) to about 100 SUS at 100° C. (212° F.) are preferred.

The oil of lubricating viscosity can be an unrefined oil, a refined oil, a rerefined oil or a mixture of at least two of these oils. An unrefined oil is an oil that is obtained directly from a natural source or a synthetic source and has not undergone any purification treatment. A refined oil is an oil that has been subjected to one or more purification treatments, such as filtration, solvent extraction, or distillation, to improve properties of the oil. A rerefined oil, also identified as a reprocessed oil or a reclaimed oil, is a refined oil that has been treated for purification after it has been in service.

An essential component of the lubrication oil composition of the present invention is the friction-modifying, polar, and surface-active organic compound selected from the group consisting of mono and higher esters of polyols, primary amines, primary ether amines, ether diamines, polyethoxylated amines, polyethoxylated diamines, the said amines and diamines containing alkyl and alkenyl groups of from 2 to about 30 carbon atoms, aliphatic amides and polyethoxylated amides containing alkyl and alkenyl groups up to about 30 carbon atoms.

Mono and higher esters of polyols useful as friction modifier components in the lubricating oil composition in the present invention are prepared from the partial esterification of an aliphatic alcohol having from 2 to 6 carbon atoms and containing from 2 to 6 hydroxyl groups with a fatty acid having from 5 to about 30 carbon atoms, including the carboxyl carbon. Thus, the partial esters may be prepared from polyhydric alcohols, such as glycol, glycerol, erythritol, pentaerythritol, the various pentitols and hexitols, such as arabitol, mannitol, sorbitol, etc. The fatty acids used to prepare the partial esters are, of course, well known, any of these acids having from about 5 to about 30 carbon atoms, such as valeric, caprylic, capric, lauric, myristic, palmitic, stearic, oleic, linoleic, etc., being suitable.

Such esters include glycerol monooleate, glycerol dioleate or combinations of these glycerol compounds in any proportion, pentaerythritol mono-, di, tri and tetra esters of $C_8$–$C_{30}$ saturated or unsaturated monocarboxylic acids or any combination of these pentaerythritol compounds. For economic reasons and reasons of easy availability, glycerol monooleate and pentaerythritol monooleate and combinations thereof are preferred.

Primary amines that are useful as friction modifier components in the lubricating oil composition of the present invention are alkyl primary amines containing alkyl and alkenyl groups of up to about 30 carbon atoms (ARMEEN ® aliphatic amines, Armak Company, Chicago, Ill.). Examples are n-octylamine, n-decylamine, n-hexadecylamine, n-octadecylamine, soyamine, tallowamine, and oleylamine, and combinations thereof.

The alkyl primary amines may be prepared by reacting an alkyl halide with ammonia, either free or in a solvent, by reduction of various nitrogen compounds, or by treatment of an amide having one more carbon than the desired amine with bromine and potassium hydroxide.

Primary ether amines of the general formula $RO(CH_2)_wNH_2$, wherein R is a $C_2$–$C_{30}$ alkyl or alkenyl radical and w is a whole number from 2 to 6, are suitable friction-modifying agents. Typical primary ether amines (ADOGEN ® primary ether amines, Sherex Chemical Company, Santa Ana, Calif.) are $C_{10}$ ether amine, $C_{13}$ ether amine, $C_{14}$ ether amine, $C_{12}$–$C_{15}$ ether amine, and $C_8$–$C_{10}$ ether amine, and combinations thereof.

Ether diamines of the general formula $ROR'NH(CH_2)_wNH_2$, wherein R and $R^1$ are $C_2$–$C_{30}$ alkyl or alkenyl radicals and w is a whole number of from 2 to 6, are suitable friction-modifying agents. Typical ether diamines (ADOGEN ® ether diamines, Sherex Chemical Company, Santa Ana, Calif.) are tridecyl ether diamines, $C_{12}$–$C_{15}$ ether diamine, and combinations thereof.

Polyethoxylated amines (Ethomeen ® polyethoxylated amines, Armak Company, Chicago, Ill.) consisting of tertiary amines having one fatty alkyl group and one to two polyoxyethylene groups attached to the nitrogen are also suitable. The alkyl groups of the polyethoxylated amines can be derived from various fatty acids having from 12 to 18 carbon atoms. A generalized structural formula for these compounds is

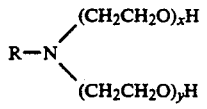

wherein x and y are whole numbers from 1–10.

Typical compounds are bis(2-hydroxyethyl)cocoamine, polyoxyethylene-(5)-cocoamine, bis(2-hydroxyethyl)soyamine, polyoxyethylene-(10)-soyamine, bis(2-hydroxyethyl)tallowamine, polyoxyethylene-(15)-tallowamine, bis(2-hydroxyethyl)oleylamine, polyoxyethylene-(15)-oleylamine, bis(2-hydroxyethyl)octadecylamine, polyoxyethylene-(50)-octadecylamine, and combinations thereof.

Polyethoxylated diamines (Ethoduomeen ® polyethoxylated diamines, Armak Company, Chicago, Ill.), can be used. Polyethoxylated diamines are the reaction products of N-alkyl trimethylene diamines and ethylene oxide. Typical compounds are N,N'-tris(2-hydroxyethyl)-N-tallow-1,3-diaminopropane; N,N'-polyoxyethylene-(10)-N-tallow-1,3-diaminopropane; N,N'-polyoxyethylene-(15)-N-tallow-1,3-diaminopropane and N,N'-tris(2-hydroxyethyl)-N-tallow-1,3-diaminopropane, and combinations thereof.

A generalized structural formula for these compounds is

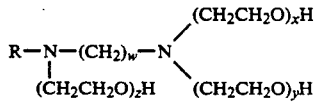

wherein x, y and z are whole numbers ranging from 1 to 10 and w is a whole number of from 2 to 6, the sum of x, y and z is at least 3, and R is a $C_8$–$C_{30}$ alkyl or alkenyl radical.

In addition, it is contemplated that ethoxylated ether amines (ADOGEN ® Series E amines, Sherex Chemical Company, Santa Ana, Calif.) having the generalized structure

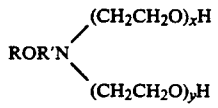

are suitable friction-modifying agents. In this formula, R is a $C_8$–$C_{30}$ alkyl or alkenyl radical, R' is a $C_2$–$C_8$ alkyl radical, and x and y each are whole numbers from 1 to 10. Suitable ethoxylated ether amines are N,N-bis(2-hydroxyethyl)-3-dodecyloxy-propylamine and N,N-bis-(2-hydroxyethyl)-2-(9-octadecenyloxy)-ethylamine.

Aliphatic amides of the structural formula R—$CONH_2$ wherein R is an alkyl or alkenyl group which may be derived from a fatty acid of from 8 to 30 carbon atoms can be utilized as a suitable friction-modifying compound in the instant invented lubricating oil composition. A suitable aliphatic amide is a hydrogenated tallowamide available from Armak Company, Chicago, Ill. under the name Armid ® aliphatic amide. Other suitable aliphatic amides are cocoamide, oleamide and octadecylamide and combinations thereof.

Polyethoxylated amides (Ethomid ® polyethoxylated amides, Armak Company, Chicago, Ill.) of the structural formula R—CONR'(R''), wherein R is an alkyl or alkenyl group of from 8 to 30 carbon atoms, R' is hydrogen, and R'' is $(CH_2CH_2O)_xH$, can also be used. Typical compounds are polyoxyethylene-(5)-oleamide, polyoxyethylene-(5)-(hydrogenated-tallow)amide, and polyoxyethylene-(50)-(hydrogenated-tallow)amide. It is contemplated that either polyethoxylated or polypropoxylated amides are suitable.

Fatty acid derivatives of alkanolamides (Varamide ® alkanolamides, Sherex Chemical Company, Santa Ana, Calif.) of the structural formula

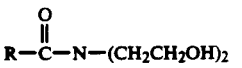

$$R-\overset{\overset{\displaystyle O}{\|}}{C}-N-(CH_2CH_2OH)_2$$

wherein R is an alkyl or alkenyl group of from 8 to 30 carbon atoms are suitable. A suitable compound is a refined coconut oil diethanolamide available as Veramide MA-1 from Sherex Chemical Company, formed by reacting diethanolamide with a fatty acid ester.

It is essential that the Group IA alkali-metal containing compound of the friction reducing composition contribute from about 10 ppm (wt) to less than about 1000 ppm (wt) of the Group IA alkali metal to the finished lubricating oil composition, preferably about 500 ppm (wt) to the finished lubricating oil composition, based on the total weight of the finished lubricating oil composition. The Group IA metal is preferably selected from the group consisting of potassium, sodium and lithium. The Group IA metal more preferred is sodium.

Although compounds containing Group IIA metals including calcium and magnesium can be present in the finished lubricating oil composition as detergents, the presence of Group IIA metals, in the absence of a Group IA metal, has not been found to result in the synergistic increase in friction reduction obtained in the presence of a Group IA metal. It is therefore essential that the Group IA alkali metal-containing compound of the friction-reducing composition contribute from about 10 ppm (wt) to about less than 1000 ppm (wt) of the Group IA metal to the finished lubricating oil composition although alkaline earth metal compounds may also be present.

A concentration of below 10 ppm (wt) of the Group IA metal in the finished lubricating oil results in a negligible increase in the friction-reducing capability of the finished lubricating oil. A concentration of and above about 1000 ppm (wt) of the Group IA metal in the finished lubricating oil composition can result in corrosion problems in the engine.

Group IIA and Group IIB metals can also be present in the lubricating oil composition. The presence of zinc dithiophosphate is required as an antiwear agent.

The friction-reducing composition of the present invention accordingly can comprise a Group IA alkali-metal component selected from the group consisting of overbased Group IA metal sulfonates, overbased Group IA metal phenates, overbased mixed Group IA metal-Group IIA metal or Group IA metal-Group IIB metal sulfonates, overbased mixed Group IA metal or Group IA metal-Group IIB metal phenates, overbased Group IIA metal or Group IIB metal sulfonates in which a Group IA metal hydroxide has been incorporated; overbased Group IIA metal, or Group IIB metal phenates in which a Group IA metal hydroxide has been incorporated, Group IA metal dialkyl, diaryl, or aryl-alkyl dithiophosphates; mixed Group IA metal-Group IIA metal dialkyl, diaryl, or aryl-alkyl dithiophosphates; and mixed Group IA metal-Group IIB metal dialkyl, diaryl, or arylalkyl dithiophosphates.

The alkali metal is a member of Group IA of the Periodic Table of Elements depicted on page 628 of WEBSTER'S SEVENTH NEW COLLEGIATE DICTIONARY, G. & C. Merriam Company, Springfield, Mass., U.S.A., 1965. Preferable Group IA metals are sodium, potassium, and lithium. More preferably, sodium is the alkali metal employed in the alkali metal compounds.

Typical of the Group IA alkali metal-containing compounds that are suitable for use in the friction reducing oil composition of the present invention are overbased Group IA alkali metal sulfonates, which may be identified as detergents. Detergents are chemical compounds which have the ability to reduce or prevent the formation of deposits in engines that are operating at high temperatures. Such chemical compounds can be sulfonates, phosphonates, and/or thiophosphates, phenates, or alkyl-substituted salicylates. Originally, normal salts of an acid were used as detergents. A normal salt of an acid is one which contains the stoichiometric amount of metal that is required to neutralize the acidic group or groups that are present. On the other hand, a basic salt is one in which there is more metal than is needed to satisfy a neutralization reaction. For example, in the case of the petroleum sulfonic acids, normal salts of petroleum sulfonic acids were used as additives in lubricating oil compositions. During World War II, normal metal sulfonates that were derived from mahogany or petroleum sulfonic acids were employed as detergent additives in crankcase oils for internal combustion engines. Typically, calcium or barium was employed as the metal in such sulfonates. Subsequently, sulfonate products which contained as much as twice as much metal as the corresponding metal sulfonate were found to have improved detergent power and ability to neutralize acidic contaminants and, hence, were used in the place of the normal sulfonates. More recently, fully oilsoluble sulfonates containing from three up to twenty or more times as much metal as a corresponding normal metal sulfonate have been developed. Such highly basic sulfonates have been identified also as "overbased," "superbased," and "hyperbased."

Over the years, numerous methods for preparing overbased sulfonates have been disclosed. In general, such overbased sulfonates have been prepared by mixing a promoter and a solvent with a normal sulfonate and an excessive amount of a metallic base of either an alkali metal or an alkaline earth metal, heating the resulting mixture, carbonating the resulting reaction mass with sufficient carbon dioxide to increase the amount of metal base colloidally disbursed as metal carbonate in the resulting product, and then filtering the resulting material. For example, in U.S. Pat. No. 3,488,284, LeSuer et al. disclosed the preparation of basic metal complexes wherein a mixture of an oil-soluble organic acid compound, such as a sulfonic acid, a basically reacting metal compound, such as sodium hydroxide, and an alcoholic promoter having from one to four hydroxyl groups, such as methanol, is treated with an inorganic acidic material, such as carbon dioxide, to form the desired basic metal complex, and subsequently the volatile materials, primarily the alcoholic promoter, are stripped from the product mass. They disclosed further that during the step in which the mixture is treated with the inorganic acidic material, the mixture must contain substantially no free water and, if water is liberated during this step, such as the water of hydration in the basically reacting metal compound, reaction conditions should be such that substantially all of such liberated water is driven off as it is formed. Additional discussions of overbased sulfonates are found in U.S. Pat. Nos. 3,779,920; 4,394,276; 4,394,277; and 4,563,293.

Overbased Group IA alkali metal phenates are suitable alkali metal-containing compounds for the lubricating oil compositions of the present invention. Such compounds not only can provide a detergent function, but also can provide corrosion inhibition and antioxidant properties.

Overbased phenates can be prepared by reacting an alkyl phenol with an excess of alkali metal or alkaline earth metal substances in the presence of a lower molecular weight dihydric alcohol, e.g., an alkane vicinal diol having up to 6 carbon atoms. A sulfurized phenate can be prepared by sulfurizing a phenolic compound to produce a sulfide, which is reacted subsequently with an alkaline earth metal compound. Alternatively, a sulfurized product can be obtained by heating elemental sulfur, an alkaline earth metal-containing compound, a phenolic compound, and a dihydric alcohol to provide simultaneous metal addition and sulfurization. The effectiveness of basic metal phenates as lubricating oil detergents is enhanced by a carbonation treatment, typically exemplified by a treatment of the basic salt with carbon dioxide. Carbonation is conducted in order to incorporate excess metal as colloidal metal carbonate in the additive. The preparation of overbased phenates and overbased sulfurized phenates is well known in the art. Examples are provided in U.S. Pat. Nos. 3,779,920; 4,394,276; 4,394,277; and 4,563,293.

Another alternative Group IA alkali metal-containing compound that is a suitable component for the friction-reducing composition of the present invention is an alkali metal dithiophosphate, preferably a sodium dithiophosphate. Such compound can be prepared as the neutralization product of the reaction of dithiophosphoric acid with a Group IA alkali metal oxide, hydroxide, or other base.

Alternatively, the alkali metal-containing compound is a reaction product obtained by reacting an overbased magnesium sulfonate or an overbased calcium sulfonate with a Group IA alkali metal hydroxide at a temperature within the range of about 149° C. (300° F.) to about 191° C. (375° F.) for a period of about 2 hr to 8 hr, accompanied by the removal of water.

The antioxidant of the friction-reducing composition comprises a transition element metal compound which is soluble or at least dispersible in hydrocarbons to provide a concentration in the finished oil of the transition metal in the range of from about 10 ppm (wt) to about 500 ppm (wt), based on total weight of the finished lubricating oil. Preferred transition metals are those of atomic number of from 21 to 47 of the Periodic Table of Elements. More preferred transition metals are cobalt, nickel, manganese and copper. The most preferred transition metal is copper.

The antioxidant component of the friction-reducing composition is essential since without the antioxidant, the fuel economy components would be ineffective because of oxidative degradation of the finished lubricating oil composition.

Suitable compounds containing copper are the copper salts of carboxylic acids, such as stearic acid, palmitic acid, oleic acid, and linoleic acid. Other compounds are copper dithiophosphate, copper dithiocarbamate, copper sulfonate, and other copper salts of oil soluble organic ligands.

The finished lubricating oil composition containing the friction-reducing composition of the present invention is prepared by blending the various components into a mixture by adding each component in an amount that will provide that component in the concentration needed for the composition. The components may be added in any sequence.

It is contemplated that the finished lubricating oil composition of the present invention, which composition is intended for use as crankcase motor oils in spark-ignited internal combustion engines, may contain other additives, such as corrosion-inhibiting agents, oxidation-inhibiting agents, pour point depressing agents, auxiliary extreme pressure agents, rust inhibitors, sludge dispersants, viscosity index improvers, color stabilizers, and antifoam agents, all of which are well known in the art and will not be discussed further herein.

The finished lubricating oil composition of the present invention will contain the composition consisting of the friction-modifying, polar, and surface-active organic compound in an amount that is in the range of about 0.05 wt % to about 2 wt %, based on the weight of the finished lubricating oil composition. Preferably, the composition will contain the friction-modifying compound in an amount in the range of about 0.25 wt % to about 0.5 wt %, based on the weight of the composition.

The Group IA alkali metal-containing compound is present in the lubricating oil composition of the present invention in an amount that is sufficient to provide said alkali metal in an amount in the range of about 10 ppm by weight (wt) to less than about 1,000 ppm (wt), preferably in an amount in the range of about 100 ppm (wt) to about 500 ppm (wt), based on the weight of said composition.

The antioxidant is present in the lubricating oil composition of the present invention in an amount that is sufficient to provide the transition element metal in an amount that is in the range of about 10 ppm (wt) to about 500 ppm (wt), preferably in an amount in the range of about 75 ppm (wt) to about 200 ppm (wt), based on the weight of the lubricating oil composition. In the case of copper, an amount of about 100 ppm (wt) is appropriate.

The following examples are presented hereinafter to help facilitate an understanding of the present invention. They are presented for the purpose of illustration and are not intended to limit the scope of the present invention, which is defined by the claims appended hereto.

EXAMPLE

Various lubricating oil compositions were prepared and each was tested for its ability to reduce fuel consumption in fuel efficient engine dynamometer (FEEO) tests. In preparing each of these lubricating oil compositions, the following blended oil composition, identified as Oil A hereinafter, was employed and comprised 98 wt % of the lubricating oil sample that was subjected to the FEEO test. The other 2 wt % of the lubricating oil sample was made up of any additional component or components to provide that particular component or components in the amount or amounts specified in the lubricating oil sample and any additional base oil to complete the 2 wt % portion. The base oil that was employed was an SX-5 solvent-extracted Mid Continent base oil. The composition of Oil A was: 80.69 wt % base oil, 12.24 wt % dispersant viscosity index improver; 2.94 wt % Mannich dispersant; 0.99 wt % zinc dithiophosphate, 0.08 wt % copper carboxylate (12% copper); 1.53 wt % low-base calcium sulfonate, (15.2 TBN), 1.22 wt % high-base magnesium sulfonate (407 TBN); and 0.31 wt % pour-point depressant. The copper carboxylate was copper octoate.

The composition of Oil A contained 249 ppm calcium from the calcium sulfonate and 1119.6 ppm magnesium from the magnesium sulfonate.

Each of these FEEO (Fuel Efficient Engine Operation) tests was conducted in a 3.8-L Buick V-6 engine, which was carbureted and run using Indolene clear (HO-III) fuel. The engine was attached to a dynamometer. The oil was not aged. In these tests, the industry reference oil HR-2 was used as a baseline. The effect of the test oil was determined by the percent difference between the mean MPG (miles per gallon) with the test oil and the reference oil.

The results of these tests are presented hereinafter in Table I. The copper carboxylate and any additional components and their amounts are provided in this table. The amount of each of these components is expressed as weight percent (wt %), based on the weight of the lubricating oil test sample. All tests were made in duplicate.

TABLE I

PERCENT FUEL REDUCTION

| Test No. | Friction-Modifying Components (wt %) | % Reduction in Fuel Consumption |
|---|---|---|
| 1 | PEMO[1] (0.5), Na[2] (0.32), Cu[3] (0.08) | 5.20 |
| 2 | Oleamide (0.2), Na[2] (0.32), Cu[3] (0.08) | 4.23 |
| 3 | GMO[4] (0.2), Na[2] (0.32), Cu[3] (0.08) | 4.15 |
| 4 | EA[5] (0.2), Na[2] (0.32), Cu[3] (0.08) | 3.60 |
| 5 | CFA[6] (0.2), Na[2] (0.32), Cu[3] (0.08) | 3.17 |
| 6 | GMO[4] (0.2), Cu[3] (0.08) | 2.71 |
| 7 | PEMO[1] (0.5), Cu[3] (0.08) | 2.73 |
| 8 | Oleamide (0.2), Cu[3] (0.08) | 2.37 |
| 9 | CFA[6] (0.2), Cu[3] (0.08) | 1.86 |
| 10 | Amoco 130[7] (2.0), Cu[3] (0.08) | 2.32 |
| 11 | Na[2] (0.32), Cu[3] (0.08) | 0.79 |
| 12 | Cu[3] (0.08), no friction modifier | 0.28 |
| 13 | EA[5] (0.2), Cu[3] (0.08) | 1.70 |

NOTE:
[1]PEMO = pentaerythritol monooleate
[2]Na = 400 TBN overbased sodium sulfonate
[3]Cu = copper octoate
[4]GMO = glycerol monooleate
[5]EA = bis(2-hydroxyethyl)oleylamine
[6]CFA = diethanolamine coco fatty amide
[7]Amoco 130 = commercial Amoco friction modifier Tests Nos. 1 through 5 utilized compositions that represent embodiments of the lubricating oil compositions of the present invention. The lubricating oil composition employed in Test No. 6 is an embodiment of the composition disclosed in European Patent Application No. 83302155.3. The sample in Test No. 10 utilized a commercial friction modifier obtained from Amoco Petroleum Additives Company, Chicago, Ill.

The data in this Table demonstrate that the lubricating oil compositions of the present invention are superior to the prior art composition and a composition containing a commercially available friction modifier in reducing fuel consumption, when used as the crankcase oil in an internal combustion engine. Moreover, the data show the unexpected synergism resulting from the combination of components and why the use of the lubricating oil compositions of the present invention in the crankcase of an internal combustion engine constitutes a method for reducing fuel consumption in that engine.

Tests 6 through 13 demonstrate that without the presence of a Group IA metal present in the finished lubricating oil composition, the % reduction in fuel consumption drops significantly.

The composition of Test No. 6 containing glycerol monoleate taught as a friction modifier in the prior art is about 65% effective as a friction modifier as compared with the same formulation as Test No. 3 which contains a Group IA metal, sodium. Similar comparisons can be made with Test No. 7 versus Test No. 1, Test No. 8 with Test No. 2, Test No. 9 with Test No. 5, and Test No. 13 with Test No. 4.

Test No. 6 through No. 13 demonstrates that the presence of a Group IA metal is required to obtain a synergistic reduction in fuel consumption. Test No. 6 through No. 13 utilized a finished lubricating oil containing Group IIA metals, specifically 249 ppm (wt) calcium and 1119.6 ppm magnesium. A Group IA metal was not in the finished lubricating oil. The percent reduction in fuel consumption in Test Nos. 6 through 13 was significantly less than in Test Nos. 1 through 5 which contained a Group IA metal in the finished oil formulation.

That which is claimed is:

1. In a lubricant composition formulated for use in the crankcase of an internal combustion engine, the improvement wherein said lubricant contains, in combination, (i) a friction modifier selected from the group consisting of glycerol monooleate, pentaerythritol monooleate, oleamide, bis(2-hydroxyethyl)oleylamine and diethanolamine coco fatty amide; (ii) a sodium sulfonate; and (iii) a copper carboxylate; and wherein said friction modifier, said sulfonate and said carboxylate are proportioned such that the lubricant composition contains an amount of said friction modifier in the range of 0.05 to 2%, an amount of sodium contributed by said sulfonate in the range of about 10 to less than 1000 ppm, and an amount of copper as said carboxylate in the range of about 10 to 500 ppm and such that said lubricant composition provides a reduction in fuel consumption averaging at least 3.17% as compared to the same lubricant composition devoid of (i), (ii) and (iii).

2. The improvement as claimed in claim 1 wherein said friction modifier is glycerol monooleate.

3. The improvement as claimed in claim 1 wherein said friction modifier is pentaerythritol monooleate.

4. The improvement as claimed in claim 1 wherein said friction modifier is oleamide.

5. The improvement as claimed in claim 1 wherein said friction modifier is bis(2-hydroxyethyl)oleylamine.

6. The improvement as claimed in claim 1 wherein said friction modifier is diethanolamine coco fatty amide.

7. A method for improving fuel economy in a spark-ignited internal combustion engine which method comprising utilizing in the crankcase of said engine a formulated crankcase lubricant composition wherein said lubricant composition contains, in combination, (i) a friction modifier selected from the group consisting of glycerol monooleate, pentaerythritol monooleate, oleamide, bis(2-hydroxyethyl)oleylamine and diethanolamine coco fatty amide, (ii) a sodium sulfonate, and (iii) a copper carboxylate; and wherein said friction modifier, said sulfonate and said carboxylate are proportioned such that the lubricant composition contains an amount of said friction modifier in the range of 0.05 to 2%, an amount of sodium contributed by said sulfonate in the range of about 10 to less than 1000 ppm, and an amount of copper as said carboxylate in a range of about 10 to 500 ppm and such that said lubricant composition provides a reduction in fuel consumption averaging at least 3.17% as compared to the same lubricant composition devoid of (i), (ii) and (iii).

8. The method as claimed in claim 7 wherein said friction modifier is glycerol monooleate.

9. The method as claimed in claim 7 wherein said friction modifier is pentaerythritol monooleate.

10. The method as claimed in claim 7 wherein said friction modifier is oleamide.

11. The method as claimed in claim 7 wherein said friction modifier is bis(2-hydroxyethyl)oleylamine.

12. The method as claimed in claim 7 wherein said friction modifier is diethanolamine coco fatty amide.

13. The improvement as claimed in claim 1 wherein said lubricant composition contains about 0.2% of glycerol monooleate as said friction modifier, about 0.32% of 400 TBN overbased sodium sulfonate as said sulfonate, and about 0.08% of copper octoate as said carboxylate.

14. The improvement as claimed in claim 1 wherein said lubricant composition contains about 0.5% of pentaerythritol monooleate as said friction modifier, about 0.32% of 400 TBN overbased sodium sulfonate as said sulfonate, and about 0.08% of copper octoate as said carboxylate.

15. The improvement as claimed in claim 1 wherein said lubricant composition contains about 0.2% of oleamide as said friction modifier, about 0.32% of 400 TBN overbased sodium sulfonate as said sulfonate, and about 0.08% of copper octoate as said carboxylate.

16. The improvement as claimed in claim 1 wherein said lubricant composition contains about 0.2% of bis(2-hydroxyethyl)oleylamine as said friction modifier, about 0.32% of 400 TBN overbased sodium sulfonate as said sulfonate, and about 0.08% of copper octoate as said carboxylate.

17. The improvement as claimed in claim 1 wherein said lubricant composition contains about 0.2% of diethanolamine coco fatty amide as said friction modifier, about 0.32% of 400 TBN overbased sodium sulfonate as said sulfonate, and about 0.08% of copper octoate as said carboxylate.

* * * * *